US012312725B2

(12) United States Patent
Wen

(10) Patent No.: US 12,312,725 B2
(45) Date of Patent: May 27, 2025

(54) PREPARATION METHOD FOR FAUX GRASS WOVEN FLANNELETTE FABRIC

(71) Applicant: Suzhou Renrui Network Technology Co., Ltd, Changshu (CN)

(72) Inventor: Minghua Wen, Suzhou (CN)

(73) Assignee: Suzhou Renrui Network Technology Co., Ltd, Changshu (CN)

( * ) Notice: Subject to any disclaimer, the term of this patent is extended or adjusted under 35 U.S.C. 154(b) by 0 days.

(21) Appl. No.: 18/947,371

(22) Filed: Nov. 14, 2024

(65) Prior Publication Data

US 2025/0066969 A1 Feb. 27, 2025

(51) Int. Cl.
*D06C 29/00* (2006.01)
*D03D 1/00* (2006.01)
(Continued)

(52) U.S. Cl.
CPC ..... *D06C 29/00* (2013.01); *D03D 1/00* (2013.01); *D03D 11/00* (2013.01); *D03D 13/004* (2013.01);
(Continued)

(58) Field of Classification Search
CPC ..... D06C 29/00; D06C 7/02; D06C 11/00; D06C 7/00; D06C 15/00; D06C 15/04; D06C 19/00; D06C 27/00; D06C 2700/15; D06C 2700/26; D06C 2700/29; D06C 2700/00; D06C 15/14; D06C 2700/13;
(Continued)

(56) References Cited

U.S. PATENT DOCUMENTS 2,160,828 A * 6/1939 Cheney ..... D06C 29/00 26/69 R
3,114,191 A * 12/1963 Chapin ..... D06C 29/00 28/162
(Continued)

FOREIGN PATENT DOCUMENTS

CN 108221162 A * 6/2018
CN 110409090 A * 11/2019 ..... D06B 21/00
(Continued)

*Primary Examiner* — Amy Vanatta
(74) *Attorney, Agent, or Firm* — Hemisphere Law, PLLC; Zhigang Ma

(57) ABSTRACT

Provided is a preparation method for a faux grass woven flannelette fabric, including the following steps: grey cloth weaving, high-speed luster finishing, high-temperature hot air blowing, high-temperature high-speed flapping, high-temperature pre-setting, low-alkali fiber opening, high-temperature dyeing, secondary heat setting, high-speed carding, secondary flapping, high-temperature setting of a finished product, and transferring of a finished fabric. A bonding force between fibers can be enhanced through high-temperature high-speed flapping, and a form of the fabric can be fixed through high-temperature pre-setting. Low-alkali fiber opening can make fibers in the woven flannelette swell and separate moderately. According to the preparation method,
(Continued)

more excellent flannelette fabrics can be provided, the competitiveness in the market is increased, the original shu velveteen and berber fleece fabrics can be replaced, and new opportunities can be obtained in the fierce market competition.

7 Claims, 1 Drawing Sheet

(51) Int. Cl.

| | |
|---|---|
| ***D03D 11/00*** | (2006.01) |
| ***D03D 13/00*** | (2006.01) |
| ***D03D 15/283*** | (2021.01) |
| ***D03D 15/47*** | (2021.01) |
| ***D03D 15/54*** | (2021.01) |
| ***D03D 27/02*** | (2006.01) |
| ***D06C 7/02*** | (2006.01) |
| ***D06C 11/00*** | (2006.01) |

(52) U.S. Cl.
CPC ..... *D03D 15/283* (2021.01); *D03D 15/47* (2021.01); *D03D 15/54* (2021.01); *D03D 27/02* (2013.01); *D06C 7/02* (2013.01); *D06C 11/00* (2013.01); *D10B 2331/02* (2013.01); *D10B 2331/04* (2013.01); *D10B 2501/00* (2013.01)

(58) Field of Classification Search
CPC ..... D03D 11/00; D03D 15/283; D03D 15/47; D03D 27/02; D03D 23/00; D03D 27/00; D03D 1/00; D03D 15/54; D03D 13/004; D03D 1/0029; D03D 25/00; D03D 25/005; D03D 27/10; D10B 2331/02; D10B 2331/04; D10B 2501/00; D10B 2401/14; D04B 1/02; D04B 21/02; D04B 39/00; D04B 39/06; D06B 2700/00; D06B 21/00; D06B 7/08; D06B 1/00; D06B 3/10
See application file for complete search history.

(56) References Cited

U.S. PATENT DOCUMENTS

| | | | | | |
|---|---|---|---|---|---|
| 3,191,258 | A * | 6/1965 | Spencer | D06M 23/18 | 28/162 |
| 3,302,265 | A * | 2/1967 | Davis | D02G 1/18 | 28/162 |
| 3,481,684 | A * | 12/1969 | Mori | D06L 4/26 | 8/111 |
| 3,940,522 | A * | 2/1976 | Wessells | E01C 13/08 | 428/397 |
| 4,118,529 | A * | 10/1978 | Nakagawa | D03D 15/37 | 28/162 |
| 4,316,928 | A * | 2/1982 | Otto | D06C 23/02 | 428/397 |
| 2011/0059288 | A1* | 3/2011 | Shavel | D04B 21/16 | 428/91 |
| 2016/0201237 | A1 | 7/2016 | Li | | |
| 2017/0159215 | A1* | 6/2017 | Ammirati | D04H 1/5416 | |
| 2020/0181815 | A1* | 6/2020 | Zhang | A41B 11/14 | |
| 2021/0115600 | A1 | 4/2021 | Sun et al. | | |
| 2022/0090303 | A1 | 3/2022 | Yang et al. | | |
| 2023/0019403 | A1* | 1/2023 | Park | D04B 21/18 | |
| 2023/0407533 | A1* | 12/2023 | Kishita | D03D 15/54 | |

FOREIGN PATENT DOCUMENTS

| | | | | | |
|---|---|---|---|---|---|
| CN | 111101300 | A * | 5/2020 | D04B 1/04 | |
| CN | 111893686 | A * | 11/2020 | D06B 15/00 | |
| CN | 111996656 | A * | 11/2020 | | |
| CN | 112746404 | A * | 5/2021 | D05C 15/34 | |
| CN | 113026173 | A * | 6/2021 | | |
| CN | 113737439 | A * | 12/2021 | | |
| CN | 114622326 | A * | 6/2022 | D03D 15/217 | |
| CN | 116180312 | A * | 5/2023 | | |
| CN | 116575172 | A * | 8/2023 | | |
| CN | 116732736 | A * | 9/2023 | | |

* cited by examiner

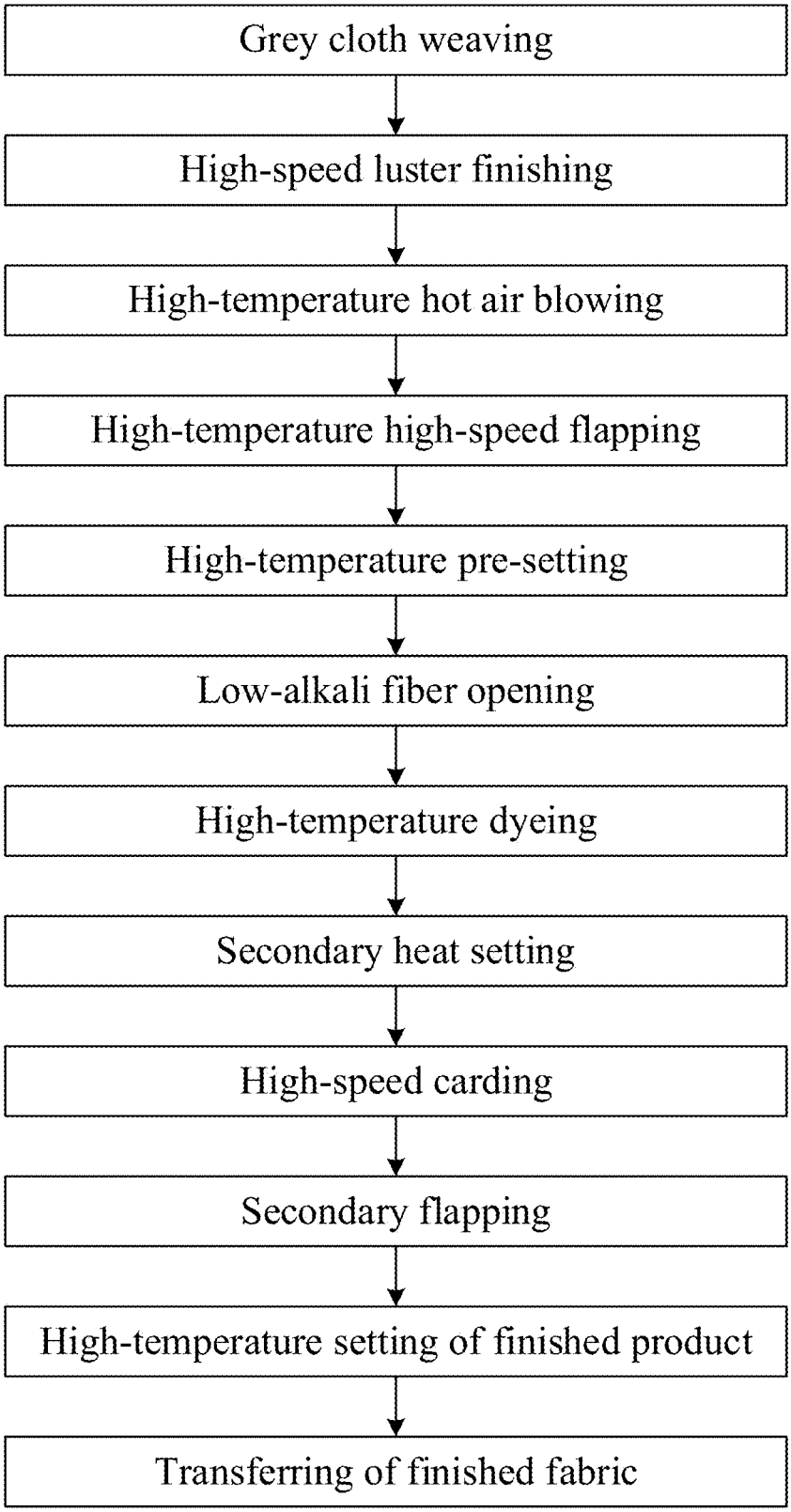
Grey cloth weaving
High-speed luster finishing
High-temperature hot air blowing
High-temperature high-speed flapping
High-temperature pre-setting
Low-alkali fiber opening
High-temperature dyeing
Secondary heat setting
High-speed carding
Secondary flapping
High-temperature setting of finished product
Transferring of finished fabric

PREPARATION METHOD FOR FAUX GRASS WOVEN FLANNELETTE FABRIC

TECHNICAL FIELD

The present disclosure relates to the technical field of woven flannelette processing, in particular to a preparation method for a faux grass woven flannelette fabric.

BACKGROUND

The woven flannelette is a fabric with fluff formed by pulling out fibers in floating threads of woven grey cloth through fleece finishing, and is an important variety of velvet woven fabrics. A weaving method of the woven flannelette makes the woven flannelette have better softness and hand feeling, which can better adapt to the body curve and bring more comfortable wearing experience. The fluff inside the woven flannelette can keep the air to a certain extent, thus keeping the body temperature and making the woven flannelette warmer in the cold season. Although there is air in the woven flannelette, its air permeability is still excellent, which can keep the body dry and make the woven flannelette more comfortable to wear. The woven flannelette can be used for printing, dyeing and other processing methods, and can be used for producing various brightly colored fabrics.

The woven flannelette has a wide range of applications, and its comfort and heat retention property make it become an ideal fabric for making clothes in autumn and winter, such as woven sportswear, sweaters, and sweatshirts. Meanwhile, the soft touch and rich colors of the woven flannelette are also suitable for making infant clothes. The woven flannelette can also be used to make sofa cover, cushion cover, bedspread, and other home accessories, which not only has good touch and heat retention property, but also can play a role in decorating the home. The woven flannel can also be used to make various industrial products, such as automobile seat covers, ship cloth, etc., with good softness, breathability, and wear resistance.

The existing flannelette fabric is generally called shu velveteen and berber fleece, which is a velvet-feeling fabric with fluff on the surface obtained by weaving, dyeing, and finishing polyester filaments. Due to its hand feeling, bulkiness and heat retention property, the velvet-feeling fabric is favored by people, and generally used in home fabrics, home clothes, and composite backings, but has the defects of single color, no layering and three-dimensional sense, leading to its inability to appear on top-grade fabrics. To this end, a preparation method for a faux grass woven flannelette fabric is provided.

SUMMARY

An objective of the present disclosure is to provide a preparation method for a faux grass woven flannelette fabric, so as to overcome the technical problem in the prior art.

To achieve the objective above, the present disclosure employs the following technical solution:

A preparation method for a faux grass woven flannelette fabric includes the following steps:

grey cloth weaving: selecting appropriate yarn materials for carding to adapt to weaving, interweaving treated materials using a weaving machine to form a three-dimensional fabric structure, and adjusting a feeding amount of materials and parameters of the weaving machine to control an extension length of plush on the surface of the fabric to meet a fabric height requirement of 1.2 cm, thus ensuring a faux grass effect of the fabric;

high-speed luster finishing: carrying out after-treatment on the grey cloth with a high-speed natural luster finishing machine, and enabling surface fibers of the grey cloth achieve effects of flatness, smoothness and brightness under the action of high-temperature and high-speed compressive rollers, where at a luster finishing temperature of 200° C., fibers on the surface of the fabric are subjected to sufficient heat, and at a working speed of 25 m/min, the natural luster finishing machine is able to treat the fabric efficiently and improve the production efficiency, and the speed also ensures uniform heating and press-finishing effect of the fabric in the luster finishing process;

high-temperature hot air blowing: carrying out air blowing treatment on the fabric in a high-temperature environment, which is conducive to setting of the fabric to make the size of the fabric more stable, and is also conducive to fixing color of the fabric to make the color on the fabric more firm and not easy to fade;

high-temperature high-speed flapping: controlling a temperature at 150° C. to achieve both effects of gigging and finishing without causing excessive thermal damage to the fabric; setting treatment time to 20 mins to ensure enough time for thermal bonding and finishing between the fibers; setting flapping speed to 180 times per minute to ensure the continuity and uniformity of the flapping process, where the bonding force between the fibers is able to be enhanced through high-temperature and high-speed flapping, thus improving the wear resistance and durability of the fabric, and in the flapping process, part of loose or redundant fibers as well as impurities are able to be removed, making the fabric more pure and tidy;

high-temperature pre-setting: controlling a temperature at 190° C., enabling the fabric to pass through a setting machine at a speed of 30 m/min to fix the size of the fabric, thus preventing the fabric from size change in the subsequent processing and use process, where the form of the fabric is able to be fixed through the high-temperature pre-setting, making the fabric have better wrinkle resistance and flatness, and the high-temperature pre-setting is also able to enhance physical properties of the fabric, such as the wear resistance, tear resistance, and stretchiness;

low-alkali fiber opening: carrying out low-alkali fiber opening to make the fibers in the woven flannelette swell and separate moderately, thus improving arrangement and interweaving states between the fibers, which is conducive to improving softness and bulkiness of the fabric, where the hygroscopicity and breathability of the woven flannelette are improved through low-alkali fiber opening treatment, and the low-alkali fiber opening is also able to be used as pretreatment for subsequent dyeing, printing and other treatment steps, which is conducive to improving the effect and uniformity of the treatment steps;

high-temperature dyeing: dyeing for 50 minutes at a high temperature of 130-140° C. to ensure that dye molecules have enough time to diffuse and fix inside the fibers, where molecular chain movement inside the fiber is intensified, which makes dye molecules easily diffused from the surface to the inside of the fiber, thus improving a fixation rate of the dye, facilitating to reduce a flooding phenomenon after dyeing, and improving the color fastness of a dyed fabric; and the high-temperature dyeing is helpful to the uniform distribution of the dye molecules in the fiber, thus improving the uniformity of the dyed fabric;

secondary heat setting: feeding the fabric into the setting machine, adjusting a temperature and speed of the setting machine to preset values, applying proper tension to keep the fabric in a stable form in the setting process, where after the fabric is heated and cooled in the setting machine for a certain period of time, the secondary heat setting treatment is able to be completed, such that the dimensional stability, thermal stability and physical and mechanical properties of the fabric are able to be significantly improved, and the handling feel and appearance of the fabric are improved at the same time;

high-speed carding: feeding the woven flannelette fabric into a carding box of a high-speed carding machine, adjusting parameters, such as a speed and a tension of the carding machine, to preset values, starting the carding machine, and carding the fabric under the action of a carding roller, after the carding is finished, turning off the carding machine, taking out the fabric for subsequent treatment, where high-speed carding is able to significantly improve the fluff effect of the woven flannelette fabric; and through carding, the fluff on the surface of the fabric is more uniform and delicate, and the beautiful degree and hand feeling of the fabric are improved; and the carding machine is able to remove impurities and burrs on the surface of the fabric to improve the cleanliness and quality of the fabric;

secondary flapping: setting a flapping temperature to 150° C., which is conducive to the further loosening and movement of fiber molecular chains in the fabric, and makes the fluff fluffier; setting flapping time to 30 min to determine that the fabric is sufficiently treated in the flapping process, which makes the fluff effect more significantly; setting a flapping speed to 180 times per minute to ensure that flapping equipment is able to flap the fabric uniformly and efficiently, where the secondary flapping is able to significantly improve the fluff effect of the woven flannelette fabric;

high-temperature setting of a finished product: heating the woven flannelette fabric at a specific temperature and in a specific time to fix the form and size of the fabric and to improve the physical properties and appearance effect of the fabric, thus improving the dimensional stability, wrinkle resistance and durability of the fabric, and improving the hand feeling and glossiness of the fabric; and transferring of a finished fabric: collecting and transferring the finished fabric after setting.

Further, in the yarn material, DTY600/1500F polyester-polyamide composite yarn is used as a top yarn, and 150D/288F all-polyester composite yarn is used as a bottom yarn.

Further, the weaving machine employs a five-station jacquard weaving machine for weaving.

Further, a temperature of high-temperature hot air blowing is set to 250° C., and treatment time is set to 20 minutes.

Further, an alkali concentration of low-alkali fiber opening is controlled at 3%, treatment time is set to 30 min, and a temperature rise rate is controlled at 1.5° C./min.

Further, a temperature of secondary heat setting is set to 180° C., and a setting speed is set at 40 m/min.

Further, a speed of high-speed carding is set to 50 m/min.

Further, a setting temperature of high-temperature setting of a finished product is set to 165° C., the setting time is set to 20 min, and a setting speed is set to 30 m/min.

Compared with the prior art, the present disclosure has beneficial effects as follows:

1. By adopting the low-alkali fiber opening process, better hand feeling and bulkiness can be obtained.

2. By adopting the five-station jacquard weaving machine, the fabric is endowed with a three-layer three-dimensional structure, and thus a more three-dimensional and natural flannelette fabric is obtained.

3. By using ultra-high-temperature and high-speed luster finishing and flapping processes, a fluff and soft hand feeling can be obtained.

4. A delicate and backbone structure can be obtained by adopting the polyester with ultra-high F number or cationic fiber yarn.

In conclusion, the preparation method can provide more excellent flannelette fabric to increase the competition force on the market and replace the original shu velveteen and berber fleece fabrics, thus obtaining new opportunities in the fierce market competition.

BRIEF DESCRIPTION OF THE DRAWINGS

To describe the technical solutions of the embodiments of the present disclosure more clearly, the following briefly introduces the accompanying drawings required for describing the embodiments. Apparently, the accompanying drawings in the following description show merely some embodiments of the present disclosure, and those of ordinary skill in the art may still derive other drawings from these accompanying drawings without creative efforts.

FIG. 1 is a schematic diagram of a process flow according to the present disclosure.

DETAILED DESCRIPTION OF THE EMBODIMENTS

The following clearly and completely describes the technical solutions in the embodiments of the present disclosure with reference to the accompanying drawings in the embodiments of the present disclosure. Apparently, the described embodiments are merely a part rather than all of the embodiments of the present disclosure. All other embodiments obtained by those of ordinary skill in the art based on the embodiments of the present disclosure without creative efforts shall fall within the scope of protection of the present disclosure.

This embodiment provides a preparation method for a faux grass woven flannelette fabric, including the following steps:

1. Grey cloth weaving. Appropriate yarn materials are selected for carding to adapt to weaving, the treated materials are interwoven using a weaving machine to form a three-dimensional fabric structure, and a feeding amount of materials and parameters of the weaving machine are adjusted to control an extension length of plush on the surface of the fabric to meet a fabric height requirement of 1.2 cm, thus ensuring a faux grass effect of the fabric.

2. High-speed luster finishing. After-treatment is carried out on the grey cloth with a high-speed natural luster finishing machine, and surface fibers of the grey cloth can achieve effects of flatness, smoothness and brightness under the action of high-temperature and high-speed compressive rollers. At a luster finishing temperature of 200° C., fibers on the surface of the fabric are subjected to sufficient heat, and at a working speed of 25 m/min, the natural luster finishing machine can treat the fabric efficiently and improve the production efficiency, and the speed also ensures uniform heating and press-finishing effect of the fabric in the luster finishing process. After the treatment of the high-speed natural luster finishing machine, the surface of the fabric is flat, smooth, and bright, the fluff is straight, and the overall effect can be comparable to that of the natural fabric. The luster finishing treatment can enhance the wear resistance, pilling resistance and wrinkle resistance of the fabric, thus improving the service life and comfort of the fabric.

3. High-temperature hot air blowing. Air blowing treatment is carried out on the fabric in a high-temperature environment, which is conducive to setting of the fabric to make the size of the fabric more stable, and is also conducive to fixing color of the fabric to make the color on the fabric more firm and not easy to fade.

4. High-temperature high-speed flapping. A temperature is controlled at 150° C. to achieve both effects of gigging and finishing without causing excessive thermal damage to the fabric. Treatment time is set to 20 mins to ensure enough time for thermal bonding and finishing between the fibers. A flapping speed is set to 180 times per minute to ensure the continuity and uniformity of the flapping process. The bonding force between the fibers can be enhanced through high-temperature and high-speed flapping, thus improving the wear resistance and durability of the fabric. In the flapping process, part of loose or redundant fibers as well as impurities can be removed, making the fabric purer and tidier. High-temperature and high-speed flapping is conducive to forming uniform fluff on the surface of the flannelette fabric, thus improving the softness and heat retention property of the fabric.

5. High-temperature pre-setting. A temperature is controlled at 190° C., and the fabric passes through a setting machine at a speed of 30 m/min to fix the size of the fabric, thus preventing the fabric from size change in the subsequent processing and use process. The form of the fabric can be fixed through the high-temperature pre-setting, making the fabric have better wrinkle resistance and flatness, and the high-temperature pre-setting can enhance physical properties of the fabric, such as the wear resistance, tear resistance, and stretchiness. During high-temperature pre-setting, it is necessary to apply proper tension to the fabric, which is helpful to maintain the flatness and dimensional stability of the fabric.

6. Low-alkali fiber opening. Low-alkali fiber opening can make the fibers in the woven flannelette swell and separate moderately, thus improving arrangement and interweaving states between the fibers, which is helpful to improve the softness and bulkiness of the fabric. The hygroscopicity and breathability of the woven flannelette are improved through low-alkali fiber opening treatment, and the low-alkali fiber opening can be used as pretreatment for subsequent dyeing, printing and other treatment steps, which is conducive to improving the effect and uniformity of the treatment steps.

7. High-temperature dyeing. Dyeing is carried out for 50 minutes at a high temperature of 130-140° C. to ensure that dye molecules have enough time to diffuse and fix inside the fibers. Molecular chain movement inside the fiber is intensified, which makes dye molecules easily diffused from the surface to the inside of the fiber, thus improving a fixation rate of the dye, facilitating to reduce a flooding phenomenon after dyeing, and improving the color fastness of a dyed fabric. The high-temperature dyeing is helpful to the uniform distribution of the dye molecules in the fiber, thus improving the uniformity of the dyed fabric.

8. Secondary heat setting. The fabric is fed into the setting machine, a temperature and speed of the setting machine are adjusted to preset values, proper tension is applied to keep the fabric in a stable form in the setting process. After the fabric is heated and cooled in the setting machine for a certain period of time, the secondary heat setting treatment can be completed, such that the dimensional stability, thermal stability and physical and mechanical properties of the fabric can be significantly improved, and the handling feel and appearance of the fabric are improved at the same time. During secondary heat setting, the proper tension needs to be applied to control the size and form of the fabric.

9. High-speed carding. The woven flannelette fabric is fed into a carding box of a high-speed carding machine, parameters, such as a speed and a tension of the carding machine, are adjusted to preset values. The carding machine is started, and the fabric is carded under the action of a carding roller. After the carding is finished, the carding machine is turned off, and the fabric is taken out for subsequent treatment. High-speed carding can significantly improve the fluff effect of the woven flannelette fabric. Through carding, the fluff on the surface of the fabric is more uniform and delicate, and the beautiful degree and hand feeling of the fabric are improved. The carding machine can remove impurities and burrs on the surface of the fabric to improve the cleanliness and quality of the fabric.

10. Secondary flapping. The flapping temperature is set to 150° C., which is conducive to the further loosening and movement of fiber molecular chains in the fabric, making the fluff fluffier. The flapping time is set to 30 min to ensure that the fabric is sufficiently treated in the flapping process, which makes the fluff effect more significantly. A flapping speed is set to 180 times per minute to ensure that flapping equipment can flap the fabric uniformly and efficiently. The secondary flapping can significantly improve the fluff effect of the woven flannelette fabric. Through high-temperature and high-speed flapping treatment, the fluff on the surface of the fabric becomes fluffier and more uniform, which can improve the beautiful level of the hand feeling of the fabric.

11. High-temperature setting of a finished product. The woven flannelette fabric is heated at a specific temperature and in a specific time to fix the form and size of the fabric. Meanwhile, the physical property and appearance effect of the fabric are improved, the dimensional stability, wrinkle resistance and durability of the fabric are improved, and the hand feeling and glossiness of the fabric are improved.

12. Transferring a finished fabric. The finished fabric after setting is collected and transferred.

In the yarn material, DTY600/1500F polyester-polyamide composite yarn is used as a top yarn, which is formed by compounding polyester (PET) and polyamide (PA), and has high strength and wear resistance, and good stretchiness and glossiness. The high F number (1500F) makes the yarn extremely fine and the fibers evenly distributed, which is beneficial to the formation of delicate fluff effect and soft hand feeling. 150D/288F all-polyamide composite yarn is used as a bottom yarn, which is made of pure polyamide, and has high strength and stability, and good wrinkle resistance and durability. The high F number (288F) makes the yarn more delicate and helps to form a compact but soft backing structure. The woven flannelette fabric with a unique three-dimensional pattern and excellent hand feeling can be produced by weaving filaments with ultra-high F number in combination with specific yarn combination and weaving process.

The weaving machine employs a five-station jacquard weaving machine for weaving, which can adjust the types and arrangement modes of the yarns at different stations as required, thus forming a complex three-dimensional pattern. The five-station design makes the pattern of the fabric richer and more diverse, which increases the appreciation and market competition of the fabric. By adopting a three-layer three-dimensional weaving technology, the top yarn, the bottom yarn and the middle layer (other yarns or materials can be selected as needed) are interwoven to form a three-dimensional fabric structure. Such a weaving mode can increase the thickness and heat retention property of the fabric, and make the surface of the fabric show a unique three-dimensional pattern. The weaving speed is set at 20 times per minutes, which can ensure that the fabric is sufficiently interwoven and set in the weaving process, and guarantee the production efficiency.

A temperature of the high-temperature hot air blowing is set to 250° C., and the treatment time is set to 20 minutes. The flannelette fabric can be softer or stiffer and smoother through proper hot air blowing treatment.

An alkali concentration in low-alkali fiber opening is controlled at 3%, which can effectively make fibers swell. The treatment time is set to 30 min to ensure that there is enough time for the fibers to swell and separate. The temperature rise rate is controlled at 1.5° C./min, thus avoiding fiber damage caused by excessive temperature rise. Moreover, in the slow temperature rise process, the fiber can gradually adapt to the temperature change, thus swelling more uniformly.

A temperature of the secondary heat setting is set to 180° C., which is enough for the fiber molecular chains in the fabric to further move and rearrange, thus stabilizing the form and size of the fabric. The setting speed is set to 40 m/min, which ensures the uniform heating and sufficient setting of the fabric in the setting process, and is also conducive to improving the production efficiency.

A high-speed carding speed is set to 50 m/min, which can ensure that the fabric is sufficiently treated during carding, and improve the production efficiency.

A setting temperature of the high-temperature setting of a finished product is set to 165° C. to ensure that the fiber molecular chains in the fabric have sufficient thermal movement, thus achieving form fixation and size stability. The setting time is set to 20 minutes to ensure that the fabric is sufficiently heated and treated in the setting process, thus achieving an expected setting effect. The setting speed is set to 30 m/minute to ensure that the fabric can pass through a heating zone evenly and stably in the setting machine, thus achieving a uniform setting effect.

In the description of this specification, descriptions referring to the terms "one embodiment", "examples" or "specific examples" mean that specific features, structures, materials or characteristics described in connection with this embodiment or example are included in at least one embodiment or example of the present disclosure. In this specification, the schematic representations of the above terms are not necessarily aimed at the same embodiment or example. Moreover, specific features, structures, materials or characteristics described may be combined in any one or more embodiments or examples in a suitable manner.

The preferred embodiments of the present disclosure disclosed above are only used to help illustrate the present disclosure. The preferred embodiment does not describe all the details in detail, nor is it limited to the specific embodiments described. Apparently, various modifications and changes can be made according to the content of this specification. These embodiments are selected and described in detail in this specification for better explanation of the principle and practical application of the present disclosure, such that those skilled in the art can better understand and utilize the present disclosure. The present disclosure is limited only by the claims and their full scope and equivalents.

What is claimed is:

1. A preparation method for a faux grass woven flannelette fabric, comprising the following steps:

(1) grey cloth weaving, comprising: selecting yarn materials, carding selected yarn materials, interweaving carded yarn materials using a weaving machine to form the grey cloth in a three-dimensional fabric structure, and adjusting a feeding amount of materials and parameters of the weaving machine to control an extension length of plush on a surface of the grey cloth to meet a fabric height requirement of 1.2 cm, thus ensuring a faux grass effect of the grey cloth;

(2) high-speed luster finishing, comprising: carrying out after-treatment on the grey cloth with a high-speed natural luster finishing machine, and enabling surface fibers of the grey cloth achieve effects of flatness, smoothness and brightness under action of high-temperature and high-speed compressive rollers, wherein at a luster finishing temperature of 200° C., fibers on the surface of the grey cloth are subjected to heat, and at a working speed of 25 m/min;

(3) high-temperature hot air blowing, comprising: carrying out air blowing treatment on the fabric in a high-temperature environment, which is conducive to setting of the fabric to make a size of the fabric more stable, and is also conducive to fixing color of the fabric to make the color on the fabric more firm and not easy to fade;

(4) high-temperature high-speed flapping, comprising: controlling a temperature at 150° C. to achieve both effects of gigging and finishing without causing excessive thermal damage to the fabric; setting treatment time to 20 mins to ensure enough time for thermal bonding and finishing between the fibers; setting a flapping speed to 180 times per minute to ensure continuity and uniformity of the flapping process, wherein a bonding force between the fibers is able to be enhanced through high-temperature and high-speed flapping, thus improving the wear resistance and durability of the fabric, and in the flapping process, part of loose or redundant fibers as well as impurities are able to be removed;

(5) high-temperature pre-setting, comprising: controlling a temperature at 190° C., passing the fabric through a setting machine at a speed of 30 m/min to fix the size of the fabric, thus preventing the fabric from size change in subsequent processing and use process, wherein a form of the fabric is able to be fixed through the high-temperature pre-setting, making the fabric have wrinkle resistance and flatness, and the high-temperature pre-setting is also able to enhance physical properties of the fabric including wear resistance, tear resistance, and stretchiness;

(6) low-alkali fiber opening, comprising: carrying out low-alkali fiber opening to make the fibers in the woven flannelette swell and separate, thus improving arrangement and interweaving states between the fibers, which is conducive to improving softness and bulkiness of the fabric, wherein hygroscopicity and breathability of the woven flannelette are improved through low-alkali fiber opening treatment, and the low-alkali fiber opening is also able to be used as pretreatment for subsequent dyeing, printing and other treatment steps, which is conducive to improving the effect and uniformity of the treatment steps;

(7) high-temperature dyeing, comprising: dyeing for 50 minutes at a high temperature of 130-140° C. to ensure that dye molecules have enough time to diffuse and fix inside the fibers, wherein molecular chain movement inside the fiber is intensified, which makes dye molecules diffused from a surface to an inside of the fiber, thus improving a fixation rate of dye, facilitating to reduce a flooding phenomenon after dyeing, and improving the color fastness of a dyed fabric; and the high-temperature dyeing facilitates uniform distribution of the dye molecules in the fiber, thus improving the uniformity of the dyed fabric;

(8) secondary heat setting, comprising: feeding the fabric into a secondary heat setting machine, adjusting a temperature and a speed of the secondary heat setting machine to preset values, applying a tension to keep the fabric in a stable form during the secondary heat setting, wherein after the fabric is heated and cooled in the secondary heat setting machine for a period of time, the secondary heat setting treatment is able to be completed, such that dimensional stability, thermal stability and physical and mechanical properties of the fabric are able to be improved, and the handling feel and appearance of the fabric are improved at the same time;

(9) high-speed carding, comprising: feeding the woven flannelette fabric into a carding box of a high-speed carding machine, adjusting parameters including a speed and a tension of the carding machine, to preset values, starting the carding machine, and carding the fabric under action of a carding roller, after the carding is finished, turning off the carding machine, taking out the fabric for subsequent treatment, wherein high-speed carding is able to improve a fluff effect of the woven flannelette fabric; and through carding, fluff on the surface of the fabric is more uniform and delicate, and a hand feeling of the fabric is improved; and the carding machine is able to remove impurities and burrs on the surface of the fabric to improve the cleanliness and quality of the fabric;

(10) secondary flapping, comprising: setting a flapping temperature to 150° C., which is conducive to the further loosening and movement of fiber molecular chains in the fabric, and makes the fluff fluffier; setting flapping time to 30 min; setting a flapping speed to 180 times per minute to ensure that flapping equipment is able to flap the fabric uniformly and efficiently, wherein the secondary flapping is able to improve the fluff effect of the woven flannelette fabric;

(11) high-temperature setting of a finished product, comprising: heating the woven flannelette fabric at a specific temperature and in a specific time to fix the form and size of the fabric and to improve the physical properties and appearance effect of the fabric, thus improving the dimensional stability, wrinkle resistance and durability of the fabric, and improving the hand feeling and glossiness of the fabric; and

(12) transferring of a finished fabric, comprising: collecting and transferring the finished fabric after setting.

2. The preparation method for the faux grass woven flannelette fabric according to claim 1, wherein the weaving machine in Step (1) employs a five-station jacquard weaving machine for weaving.

3. The preparation method for the faux grass woven flannelette fabric according to claim 1, wherein in Step (3), a temperature of high-temperature hot air blowing is set to 250° C., and treatment time is set to 20 minutes.

4. The preparation method for the faux grass woven flannelette fabric according to claim 1, wherein in Step (7), an alkali concentration of low-alkali fiber opening is controlled at 3%, treatment time is set to 30 min, and a temperature rise rate is controlled at 1.5° C./min.

5. The preparation method for the faux grass woven flannelette fabric according to claim 1, wherein in Step (8), a temperature of secondary heat setting is set to 180° C., and a setting speed is set at 40 m/min.

6. The preparation method for the faux grass woven flannelette fabric according to claim 1, wherein in Step (9), a speed of high-speed carding is set to 50 m/min.

7. The preparation method for the faux grass woven flannelette fabric according to claim 1, wherein in Step (11), a setting temperature of high-temperature setting of a finished product is set to 165° C., the setting time is set to 20 min, and a setting speed is set to 30 m/min.

* * * * *